US006189687B1

(12) United States Patent
Bakx

(10) Patent No.: US 6,189,687 B1
(45) Date of Patent: Feb. 20, 2001

(54) ARTICLE CARRIER AND BLANK THEREFOR

(75) Inventor: Martinus C. M. Bakx, Goes (NL)

(73) Assignee: The Mead Corporation, Dayton, OH (US)

( * ) Notice: Under 35 U.S.C. 154(b), the term of this patent shall be extended for 0 days.

(21) Appl. No.: 09/331,330

(22) PCT Filed: Dec. 19, 1997

(86) PCT No.: PCT/US97/24240

§ 371 Date: Jun. 18, 1999

§ 102(e) Date: Jun. 18, 1999

(87) PCT Pub. No.: WO98/28200

PCT Pub. Date: Jul. 2, 1998

(51) Int. Cl.[7] ..... B65D 75/00

(52) U.S. Cl. ..... 206/175; 206/180; 206/190; 206/186; 229/117.14; 229/120.09

(58) Field of Search ..... 206/175, 180, 206/190, 186, 170, 162, 427; 229/117.14, 120.09, 120.11

(56) References Cited

U.S. PATENT DOCUMENTS

| | | | | |
|---|---|---|---|---|
| 2,795,352 | * | 6/1957 | Ringler | 206/190 |
| 3,326,411 | | 6/1967 | Crouch | 206/187 |
| 3,712,505 | * | 1/1973 | Slevin | 206/187 |
| 3,814,237 | * | 6/1974 | Forrer | 206/175 |
| 4,396,116 | * | 8/1983 | Stone | 206/427 |
| 5,161,732 | * | 11/1992 | Clein et al. | 206/180 |
| 5,531,319 | * | 7/1996 | Harrelson | 206/190 |
| 5,538,131 | * | 7/1996 | Harrelson | 206/186 |
| 5,657,864 | * | 8/1997 | Harrelson | 206/152 |
| 5,979,645 | * | 11/1999 | Holley, Jr. | 206/427 |
| 6,003,665 | * | 12/1999 | Stout | 206/175 |

* cited by examiner

*Primary Examiner*—Paul T. Sewell
*Assistant Examiner*—Troy Arnold
(74) *Attorney, Agent, or Firm*—Michael V. Drew

(57) ABSTRACT

The present invention and its preferred embodiments relate to an article carrier which is shaped to provide satisfactory strength to hold the bottles securely but with a degree of flexibility so that the load transferred to the handle is absorbed by a carrier. The shape of the blank minimises the amount of paperboard required. The carrier can be applied to an array of bottles by hand or automatic machinery. It is anticipated that the invention can be applied to a variety of carrier and not limited to those of the basket carrier type.

5 Claims, 4 Drawing Sheets

ARTICLE CARRIER AND BLANK THEREFOR

This invention relates to an article carrier of the basket type adapted to accommodate a plurality of articles, such as bottles and to a blank for forming the carrier. Normally a basket carrier for bottles includes a central (medial) partition structure which incorporates a handle structure by which the carrier can be lifted and carried and the bottles are arranged in rows on either side of the partition structure. More often than not, bottles are separated from one another by transverse partition panels extending from each side of the medial partition structure to the adjacent side wall of the carrier. Hence, in this type of arrangement the bottles are accommodated in individual cells of the carrier although such cells are not essential.

One example of basket type carriers is illustrated in U.S. Pat. No. 3,326,411. The side and end wall panels are positioned on opposite sides of handle panels and an internal partition structure. The handle panels are defined in part by cut lines which define its side and upper edges and interrupt a central foldline.

A problem associated with carriers of the basket type is that the partition structure is often required to extend deeply into the carrier. A consequence of this requirement is that more paperboard is needed. The present invention should be capable of being designed with partitions which may extend relatively deeply into the carrier, whilst minimising the amount of board required. What is also required is a blank which can retain its integrity during the folding process.

One aspect of the invention provides a blank for forming an article carrier of the basket type comprising opposing side and end walls foldably connected together in series, a base, medial support means and an internal partition structure and handle means positioned within the blank with a first edge adjacent the opposing side and end walls.

At least one panel forming the opposed side and end walls is connected to the handle means. The medial support means and the internal partition structure extend outwardly of an opposing edge of the handle means and are connected to the handle means by a first fold line and a second fold line, the first fold line and second fold line being separated by a first cut line which defines an edge of the handle means.

Accordingly to an optional feature of this aspect of the invention, the first cut line may further define a side edge of the handle means.

According to another optional feature of this aspect of the invention, the position of the first and second fold lines may be selectively located relative the upper edge of the opposed side and end walls according to the required depth of partition structure such that the transverse dimension of the opposed side and end walls remain unaltered. Alternatively, the first and/or second fold lines may be positioned relative to the side edges of the handle means according to the height of the internal partition structure required.

According to a further optional feature of this aspect of the invention the handle means may further comprise a handle panel with an upper edge defined by the first cut line and a lower edge separated from at least one of the side and end walls by a second cut line. Optionally, the handle means may further comprise a second handle panel adjacent the first handle panel and foldably connected together along a common end edge and interposed between the panels forming the medial support means and the internal partition structure and the or each panels forming at least one of the end and side walls.

According to yet another optional feature of this aspect of the invention the or each handle panel may be connected to opposing end walls.

Optionally, the base is foldably connected to a panel forming at least one of the side and end panels.

A second aspect of the invention provides an article carrier of the basket type formed from a blank described herein.

Figure 3:
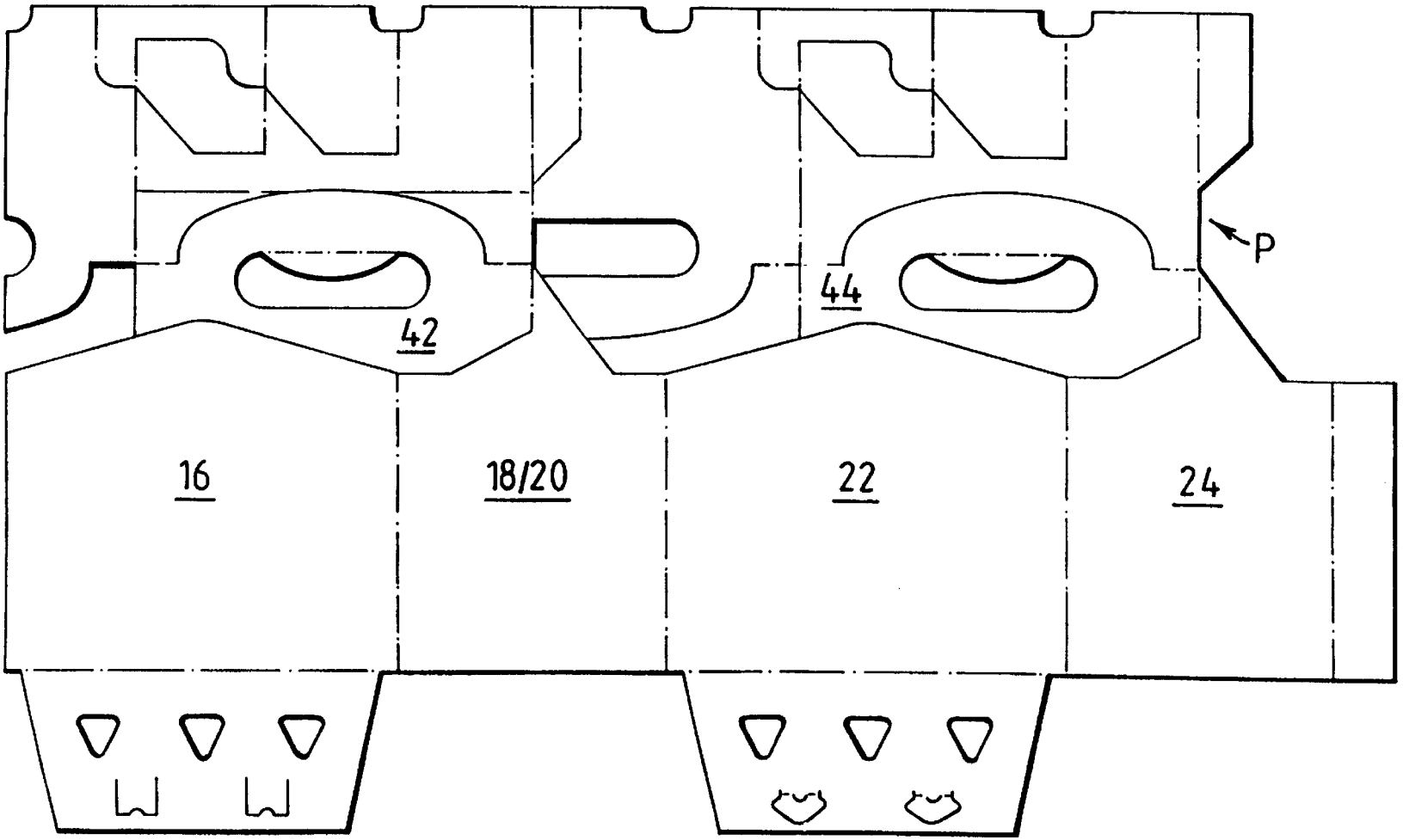
Figure 4:
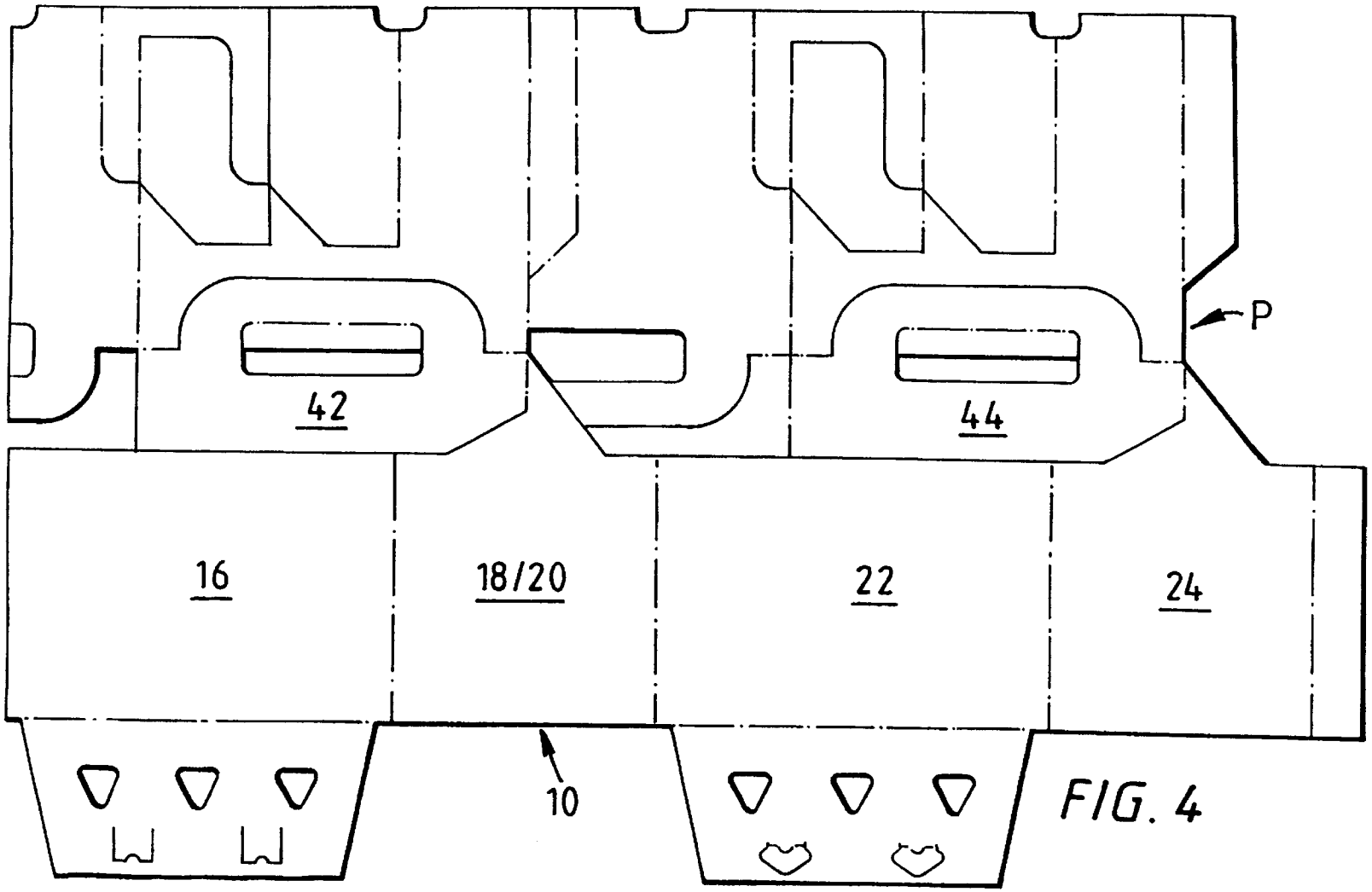

FIG. 3 is a plan view of a blank for forming a basket carrier, according to a second preferred embodiment of the invention, which includes an alternative handle and internal partition formation; and FIG. 4 is a plan view of a blank for forming a basket carrier, according to a third preferred embodiment of the invention, which includes another alternative handle formation and internal partition structure.

Figure 1:
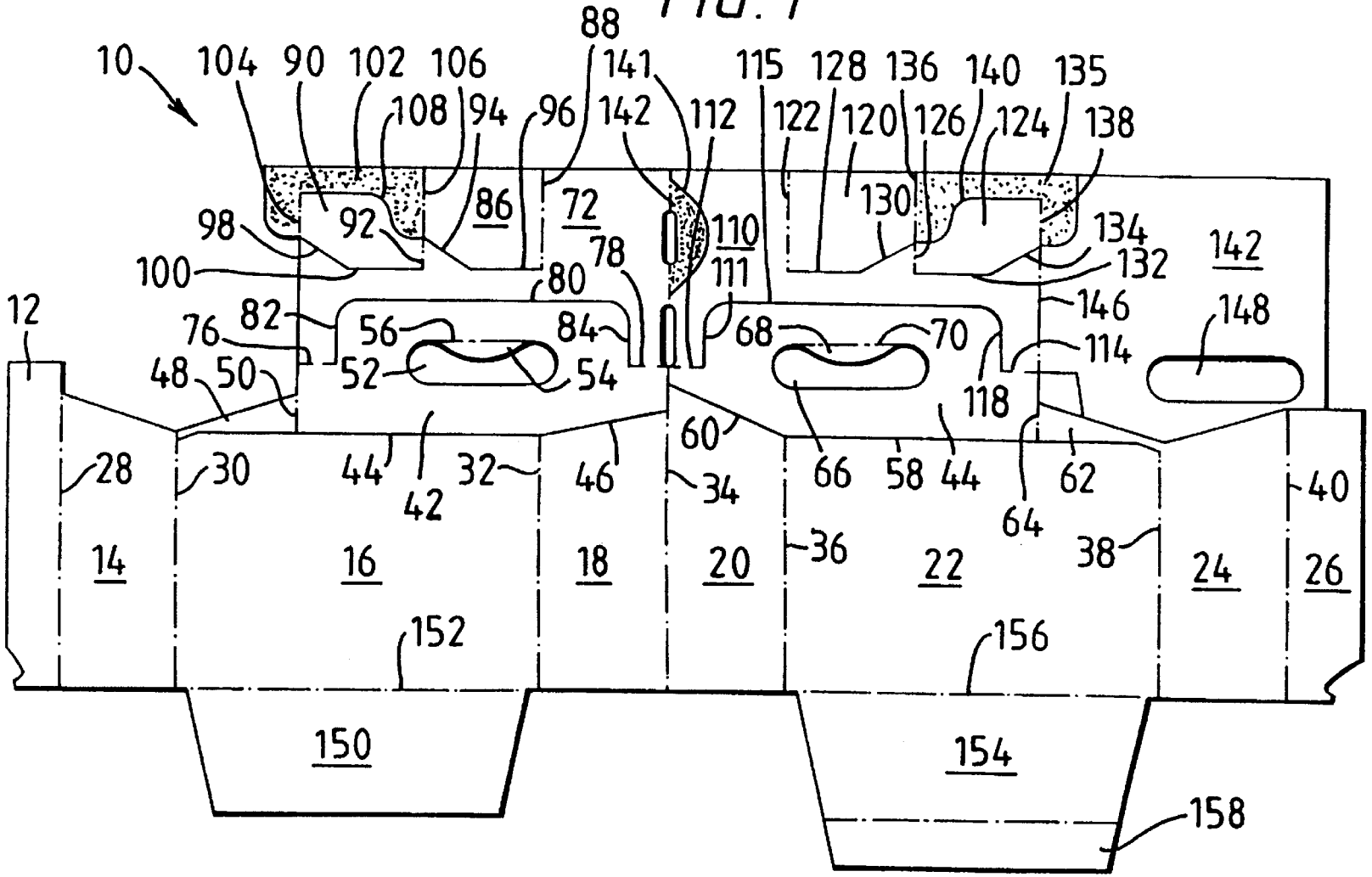
FIG. 1 is a plan view of a blank for forming a basket carrier, according to a preferred embodiment of the invention.

Referring to the drawings, and in particular FIG. 1 thereof, a bottle carrier is formed from a single blank 10 of paperboard or other suitable foldable sheet material and is adapted to accommodate six bottles arranged in two rows of three bottles each. The blank includes securing panel 12, first end panel 14, first side panel 16, second end panel 18, third end panel 20, second side panel 22, fourth end panel 24 and securing panel 26, hingably connected one to the next along fold lines 28, 30, 32, 34, 36, 38 and 40 respectively.

An outer handle panel 42 is disposed adjacent end panel 18 and side panel 16. Handle panel 42 is separated from side panel 16 by a cut line 41 and from end panel 18 by cut line 46. Handle panel 42 is connected to first end panel 14 along one side edge of handle panel 42 by means of a tapered connecting portion 48. The connecting portion 48 is foldably connected to handle panel 42 along fold line 50, and foldably connected to first end panel 14 along fold line 30. Cut line 44 separates connecting portions 48 from side panel 16 and is shaped to provide a narrow portion adjacent end wall 14. The end of this narrow portion is sufficient to maintain the connection between the handle panel 42 and end panel 14 during handling of the blank prior to folding and gluing.

Handle panel 42 includes a hand aperture 52. A hand cushioning flap 54 is connected along fold line 56 to an upper edge of hand aperture 52.

A similar outer handle panel 44 is disposed adjacent third end panel 20 and second side panel 22. Handle panel 44 is separated from side panel 22 by a cut line 58 and from end panel 20 by cut line 60. Handle panel 44 is connected to fourth end panel 24 along one side by means of a tapered connecting portion 62. The connecting portion 62 is foldably connected to handle panel 44 along fold line 64 and foldably connected to fourth end panel 24 along fold line 38. Cut line 58 separates connecting portion 62 from side panel 22 and is shaped to provide a narrow portion adjacent fourth end panel 24. The end of this narrow portion is sufficient to maintain the connection between the handle panel 44 and fourth end panel 24 during handling of the blank prior to folding and gluing.

Other handle panels 42 and 44 are hingably connected to third end panel 20 along their common side edge by an extension of fold line 34.

Figure 2:
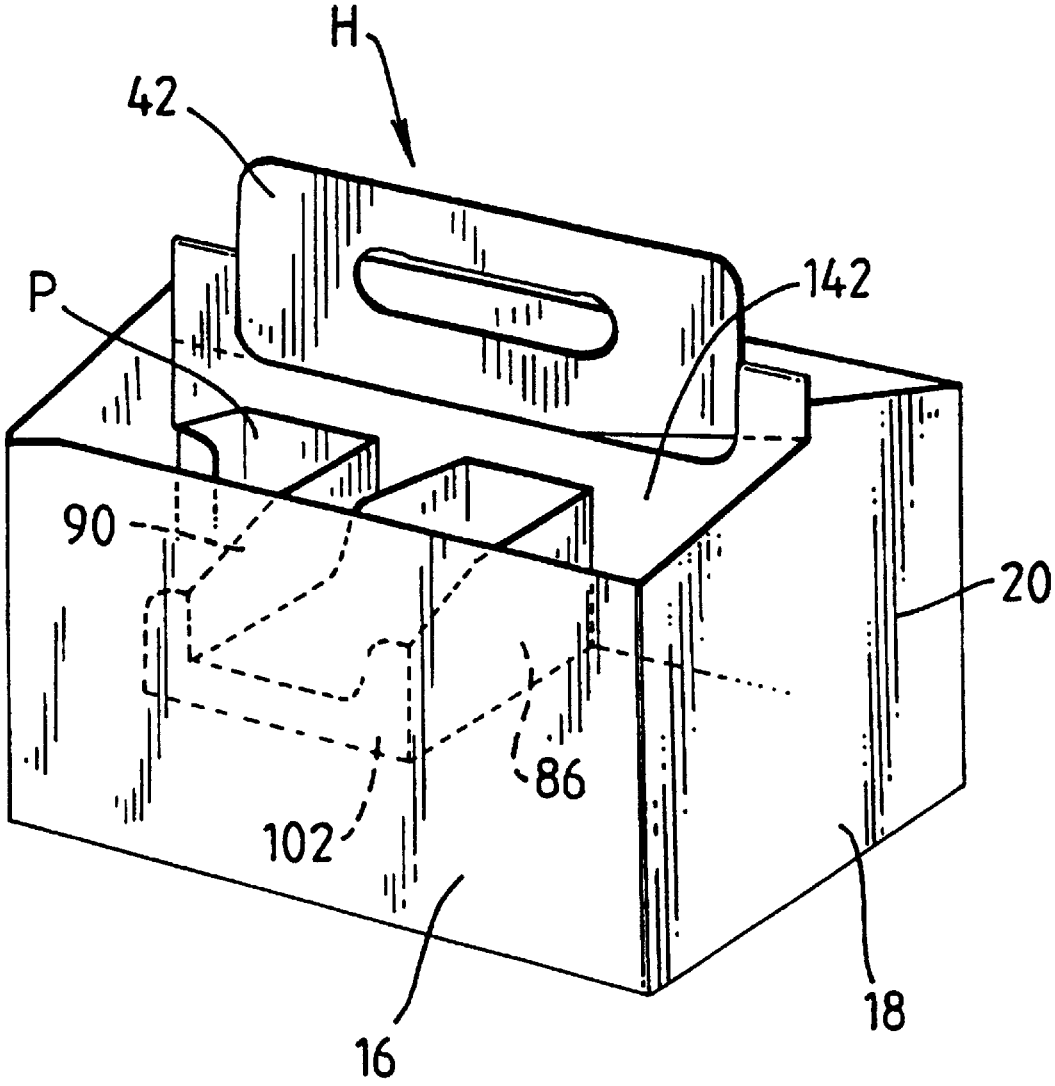
FIG. 2 is an isometric illustration of a bottle carrier formed from the blank of FIG. 1.

A partition structure P, shown in FIG. 2, for the article carrier is formed along the upper ends of handle panels 42 and 44. Specifically, partition panel 72 is connected to handle panel 42 along fold lines 76 and 78. Cut line 80 connects one end of fold line 76 to one end of fold line 78 and defines the upper edge of handle panel 42 and part of its opposing side edges 82, 84. A transverse panel 86 is hingably connected to partition panel 72 along fold line 88. A second transverse panel 90 is hingably connected to partition panel 72 by fold line 92.

Transverse panel 86 is separated from partition panel 72 by cut lines 94 and 96 which extend between fold lines 88 and 92. Second transverse partition panel 90 is separated from partition panel 72 by cut lines 98 and 100 which extend between fold line 92 and the side edge of partition panel 72.

A glue panel 102 is positioned adjacent to transverse panel 90: being connected to transverse panels 86 and 90 by fold lines 104, 106 respectively. The glue panel 102 is separated from transverse panel 90 by cut line 108 which extends between fold line 92 and fold line 104.

A second partition panel 110 is connected to handle panel 44 along fold lines 112 and 114. Cut line 115 connects one end of fold line 112 to one end of fold line 114 and defines the upper edge of handle panel 44 and part of its opposing side edges 116, 118. A transverse panel 120 is connected to second partition panel 110 along fold line 122. A second transverse panel 124 is hingably connected to second partition panel 110 by fold line 126. Transverse panel 120 is separated from second partition panel 110 by cut lines 128 and 130 which extend between fold lines 122 and 126. Transverse panel 124 is separated from second partition panel 110 by cut lines 132 and 134 which extend between fold line 126 and the side edge of second partition panel 110.

A glue panel 135 is positioned adjacent to transverse panel 124 being connected to transverse panels 120 and 124 by fold lines 136, 138 respectively. Glue panel 135 is separated from transverse panel 124 by cut line 140 which extends between fold line 126 and fold line 138.

First and second partition panels are hingably connected together along their common side edge by fold line 34 which is interrupted by cut line 141 defining medial support panel 142.

An inner handle panel 144 is hingably connected to second partition panel 110 along fold line 146. Handle panel 144 comprises a hand aperture 148 which is positioned to be aligned with hand apertures 52, 66 when the carton is constructed.

Turning to the construction of the base, a first base panel 150 is hingably connected to first side wall 16 along fold line 152. A second base panel 154 is foldably connected to second side wall 22 along fold line 156. A glue flap 158 is connected to the opposite edge of base panel 154.

The construction of the completed carrier in a flat collapsed condition from the blank requires a series of sequential folding and gluing operations.

Thus, the folding of the blank of FIG. 1 to form the completed article carrier is begun by applying glue to glue flaps 102, 142, 135, 158 and panels 12, 40. In addition, glue may be applied to the surface of either or both sides of inner handle panel 142.

The blank is then folded along fold lines 76, 78 and 112, 114 so that partition panels 72 and 110 are in a face to face relationship with respective one of handle panels 42 and 44 and may be secured thereto by glue or other means known in the art. Glue flaps 102 and 135 are secured to respective side panels 16 and 22. Inner handle panel 142 is folded about fold line 146 and into a face to face relationship with outer handle panel 44 and connected together. Tab 142 is connected to end panel 20 by glue or other known means and provides additional support to the connection between the partition structure and outer panels.

The two sides of the basket carrier are then brought into face to face relationship by folding about fold line 34 with outer handle panel 42 being secured to inner handle panel 142 by glue or other means known in the art.

End panel 14 and support panel 12 are folded into a face to face relationship with respective end panel 24 and support panel 26 about fold lines 30, 38 respectively. Each support panel 12, 26 is then connected together with the hooks 160 shown in FIG. 1 facing the partition structure and the end panels connected to connecting portions 48, 62 by glue or other known means.

Support panels 12/26 are connected to handle structure H (shown in FIG. 2) by glue or other means known in the art. It is to be expected that some tearing to the narrow parts of the connecting portions 48, 62 may occur. Any such tearing will be aesthetically unnoticeable. Further, because the carrier has been glued, the connection portions to hold the blank together are no longer needed for this purpose.

In use, the article carrier is erected by moving the outer edges of the collapsed carrier defined by fold lines 30, 38 and 34 inwardly towards each other. This moves end panels 14, 24 and 18, 20 and side panels 16 and 22 into a rectangular configuration. This facilitates the construction of individual cells. Thus, transverse partition panels 86, 90 are moved out of alignment with first side panel 16 and partition panel 72 and are folded about fold lines 88, 106 and 92, 104 respectively so that three cells are formed as illustrated in FIG. 2. Similarly, transverse partition panels 120, 124 are moved out of alignment with second side panel 22 and partition panel 110 and are folded about fold lines 122, 136 and 126, 138 respectively so that three cells are formed.

FIG. 2 shows the position of the cells and medial panels when the carton is in a set up condition.

The carton is then ready to receive articles (not shown) which are loaded by relative vertical movement between the bottles and carrier during forward feed movement, well known in the art, by which bottles enter their respective cells through the open bottom of the carrier. Thereafter, the base is formed by folding first and second base panels 150, 154 into a substantially perpendicular relationship with side walls 16, 22 respectively and the free edge of each base panel is then secured together with the glue flap 158 to form the base of the carrier and held in place by hooks 160.

Handle tabs 54, 68 are folded about handle panels 42, 44 to further secure handle panel structure H and the carton as shown in FIG. 2 of the drawings.

FIGS. 3 and 4 illustrate further embodiments which are similar in construction to the embodiment hereinbefore described, as will be understood by those in the skilled art.

The depth of the internal partition structure can be reduced or increased, in accordance with specific requirements, by moving fold lines 76, 78, 112, 114 towards or away from the side and end walls. Likewise, the invention enables the handle shape to be altered easily by changing the profile of cut lines 80, 115, for example.

What is claimed is:

1. A blank for forming an article carrier of the basket type, the blank comprising:

a plurality of wall panels, each of said wall panels having a top edge, a bottom edge, and opposed side edges, said wall panels being foldably connected in a series along said side edges;

handle means comprising at least one handle panel having a lower edge disposed adjacent to said top edge of at least one of said wall panels, said handle panel being connected to at least one of said wall panels, said handle panel further including an upper edge disposed opposite said lower edge thereof and remote from said wall panel;

medial support means and internal partition structure comprising at least one medial support panel, said medial support panel disposed adjacent said upper edge of said handle panel;

said medial panel being connected to said handle panel by a first fold line and a second fold line, said first fold line and said second fold line being separated by a first cut line that defines said upper edge of said handle panel.

2. A blank according to claim 1, wherein said first fold line and said second fold line are disposed in an offset relationship with respect to said upper edge of said handle panel.

3. A blank according to claim 1, wherein said first cut line further defines a side edge of said handle panel, and wherein said first fold line terminates at said side edge of said handle panel.

4. A blank according to claim 1, wherein said lower edge of said handle panel is defined by a second cut line separating said handle panel from the one of said wall panels having a top edge adjacent to said handle panel.

5. A blank according to claim 1, wherein said first fold line and said second fold line are disposed between and generally parallel to said upper edge of said handle panel and said second cut line.

* * * * *